US005181834A

United States Patent [19]

Ikeda et al.

[11] Patent Number: 5,181,834

[45] Date of Patent: Jan. 26, 1993

[54] SWASH PLATE TYPE COMPRESSOR

[75] Inventors: Hayato Ikeda; Toshiro Fujii; Naoya Yokomachi; Shoji Takemoto, all of Kariya, Japan

[73] Assignee: Kabushiki Kaisha Toyoda Jidoshokii Seisakusho, Kariya, Japan

[21] Appl. No.: 917,451

[22] Filed: Jul. 21, 1992

Related U.S. Application Data

[63] Continuation-in-part of Ser. No. 880,574, May 8, 1992, and a continuation-in-part of Ser. No. 863,814, Apr. 6, 1992, which is a continuation-in-part of Ser. No. 884,721, May 18, 1992.

[30] Foreign Application Priority Data

Jul. 26, 1991 [JP] Japan ..... 3-187851

[51] Int. Cl.[5] ..... F04B 1/16

[52] U.S. Cl. ..... 417/269; 91/502; 92/71; 184/6.17

[58] Field of Search ..... 417/269, 271, 222 R; 92/71, 110; 91/499, 502; 123/58 BB

[56] References Cited

U.S. PATENT DOCUMENTS

| | | | |
|---|---|---|---|
| 3,079,869 | 3/1963 | Purcell | 91/501 |
| 3,734,647 | 5/1973 | Sparks | 417/269 |
| 3,888,604 | 6/1975 | Oshima et al. | 417/269 |
| 5,052,898 | 10/1991 | Cook | 417/269 |

FOREIGN PATENT DOCUMENTS 54-55711 4/1979 Japan .

392587 4/1991 Japan .

*Primary Examiner*—Leonard E. Smith

*Attorney, Agent, or Firm*—Brooks Haidt Haffner & Delahunty

[57] ABSTRACT

A swash plate type compressor is provided with a front and rear cylinder blocks having a crank case connected to a suction port. The cylinder blocks include a plurality of cylinders, and are connected to a front and rear housing sections for covering the cylinders. Each housing section contains a discharge chamber. A drive shaft is rotatabley supported by the cylinder blocks. A swash plate is mounted on the drive shaft and is rotatably disposed within the crank case. Two-head pistons move within their respective cylinders in cooperation with the swash plate. The refrigerant is drawn into, and compressed in each cylinder. Thereafter, it is discharged into the external refrigerating circuit through the front and rear discharge chambers, and a final discharge port. A discharge passage includes a hollow primary passage which is provided within the drive shaft. The primary passage communicates with the front and rear discharge chambers. A groove is provided on an inner wall of the primary passage. As the drive shaft rotates, the groove separates the refrigerant from the lubricating oil mixed with the refrigerant. An oil passage is provided between the discharge chamber and the crank case. The separated oil flows from the discharge chamber to the crank case, through the oil passage, and is used again in lubricating the components of the compressor.

5 Claims, 2 Drawing Sheets

SWASH PLATE TYPE COMPRESSOR

CROSS REFERENCE TO RELATED APPLICATIONS

This is a continuation in part application of the co-pending U.S. application Ser. No. 07/880,574, filed on May 8, 1992, entitled SWASH PLATE TYPE COMPRESSOR, which is a continuation in part of the U.S. application Ser. No. 07/863,814, filed on Apr. 6, 1992, entitled SWASH PLATE TYPE COMPRESSOR WITH A CENTRAL DISCHARGE PASSAGE, which are incorporated herein by reference. This application is also a continuation in part of the co-pending application Ser. No. 07/884,721, filed on May 18, 1992, entitled SWASH PLATE TYPE COMPRESSOR, which is also incorporated herein by reference.

BACKGROUND OF THE INVENTION

This application claims the priority of Japanese Patent Application No. 3-187851, filed on Jul. 26, 1991, which is incorporated herein by reference.

FIELD OF THE INVENTION

The present invention relates to swash plate type compressors, and more particularly, it relates to an improved swash plate type compressor for use in vehicles.

DESCRIPTION OF THE RELATED ART

Japanese Unexamined Patent Publication No. 3-92587 discloses a swash plate type compressor which includes a front and rear cylinder blocks. A crank case is connected to a refrigerant suction port, and is located at an interface section between the front and rear cylinder blocks. Each cylinder block has a distal end which is covered by a corresponding housing section. A front valve plate is disposed intermediate the front cylinder block and the front housing section. Similarly, a rear valve plate is disposed intermediate the rear cylinder block and the rear housing section. Each housing sections includes a suction chamber and a discharge chamber. The discharge chamber leads to a refrigerant discharge port.

A drive shaft rotatably enters through an axial opening in the front and rear cylinder blocks. A swash plate is fixedly mounted on the drive shaft and is rotatably disposed within the crank case. The valve plates include suction ports which connect the suction chambers to a plurality of cylinders, via corresponding suction valves. Each cylinder houses a two-head type piston. The piston is reciprocatable in the cylinder in relation to the rotation of the swash plate. Each valve plate also has a discharge port which connects each discharge chamber with each cylinder via a discharge valve. Each cylinder block has a plurality of suction passages which connect the crank case to the front and rear suction chambers, and a discharge passage which interconnects the front and rear discharge chambers.

The discharge passage is located such that the discharge passage does not interfere with the suction passage and the crank case. Due to design restrictions, such as the limited external dimensions, the discharge passage has to be positioned close to the suction passage. In such arrangement, however, the refrigerant flows from an external refrigerating circuit to the crank case and the suction passage, through the suction ports. The refrigerant absorbs heat from the hot and compressed refrigerant flowing through the discharge passage. The refrigerant is compressed to a higher temperature and is then discharged. As a result, the circulation of the discharged heated refrigerant increases the load on the refrigerating circuit, thus lowering its cooling ability and the overall efficiency of the compressor.

Moreover, the discharged refrigerant in the conventional compressor is mixed with lubricating oil. As a result, the quantity of oil available for lubrication might become insufficient to lubricate the compressor. This will reduce the efficiency of the heat exchange in the external refrigerating circuit, and will further lower the cooling efficiency of the compressor.

In an attempt to address this problem, conventional compressors has been fitted with separate oil lubricating structures. These structures separate the lubricating oil from the refrigerant, and recycle the separated oil from higher pressure section in the compressor to the lower pressure section in the compressor.

However, separate structures almost inevitably increase the size of the compressor.

SUMMARY OF THE INVENTION

It is therefore an object of the present invention to significantly minimize the overheating of the refrigerant.

It is also an object of the present invention to provide a compressor which accommodates a relatively simple lubricating oil separate structure.

In order to achieve the foregoing objects, the swash plate type compressor of the present invention is provided with a front and rear cylinder blocks having a crank case connected to a suction port. The cylinder blocks have a plurality of cylinders. The cylinder blocks are connected to a front and rear housing sections in order to cover the cylinders. Each housing section contains a discharge chamber.

A drive shaft is rotatably supported by the cylinder blocks. One end of the drive shaft is sealed within the front housing. A swash plate is mounted on the drive shaft and is rotatably disposed within the crank case.

A plurality of two-head pistons engage the swash plate via a pair of shoes. The pistons move within their respective cylinders in cooperation with the swash plate. The refrigerant is drawn into each cylinder via a suction passage, and is then compressed in the cylinders. Thereafter, it is discharged into the external refrigerating circuit through the front and rear discharge chambers, and a discharge port.

A discharge passage includes a hollow primary passage which is provided within the drive shaft. The primary passage communicates with the front and rear discharge chambers. A groove is provided on an inner wall of the primary passage. A lubricating oil is mixed with the refrigerant. According to the rotation of the drive shaft, the groove separates the lubricating oil from the refrigerant. An oil passage is provided between the discharge chamber and the crank case. The separated oil flows from the discharge chamber to the crank case through the oil passage to recycle itself.

BRIEF DESCRIPTION OF THE DRAWINGS

The invention, together with objects and advantages thereof, may best be understood by reference to the following description of the presently preferred embodiments together with the accompanying drawings in which.

DESCRIPTION OF THE PREFERRED EMBODIMENT

Figure 1:
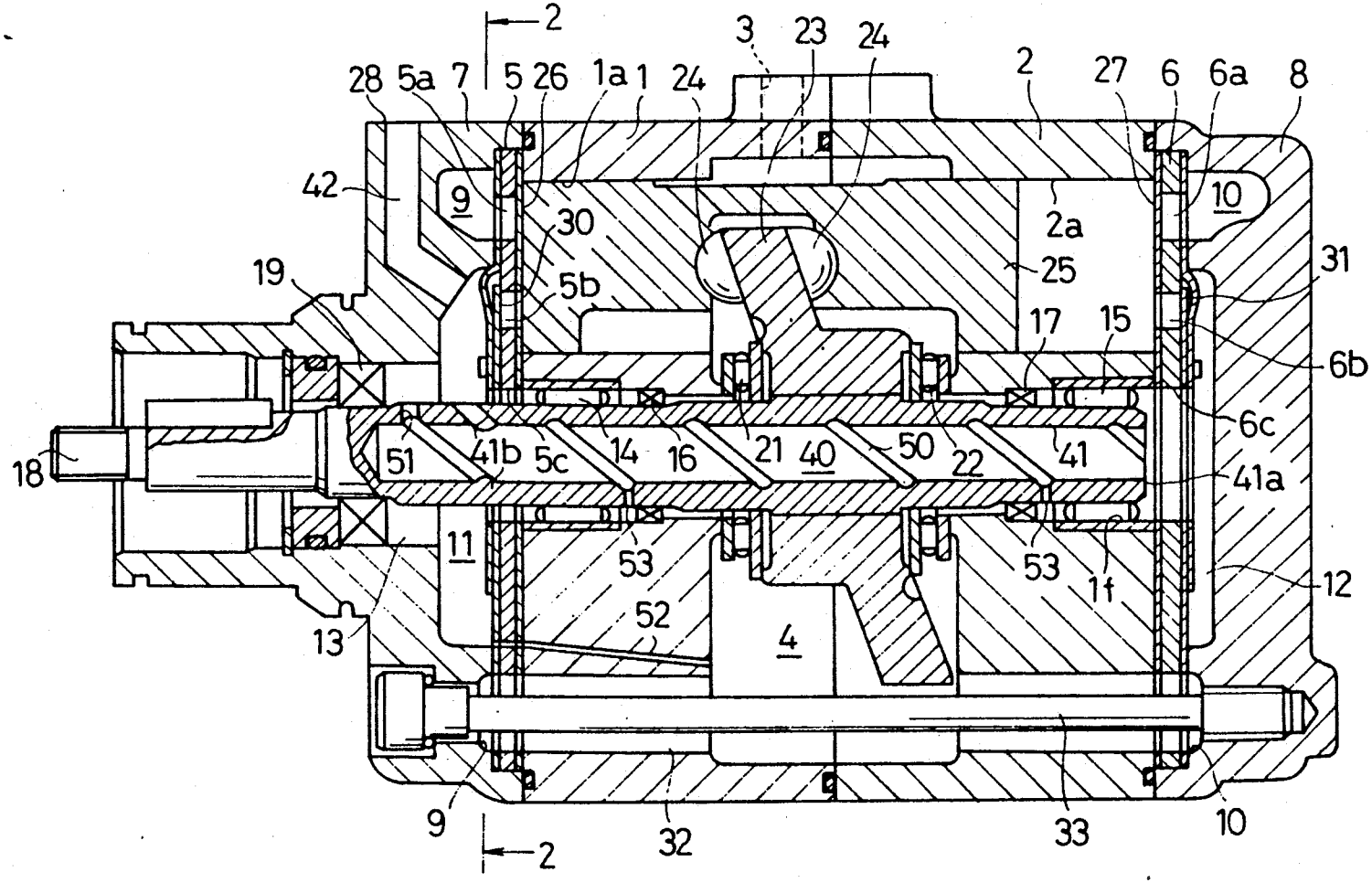
FIG. 1 is a sectional view of a swash type compressor according to a preferred embodiment of the present invention.

FIG. 1 illustrates the preferred embodiment of a swash plate type compressor according to the present invention. The compressor includes a front and rear cylinder blocks 1 and 2 which are oppositely disposed with respect to each other. A crank case 4 is centrally disposed with respect to the cylinder blocks 1 and 2, and leads to a suction port 3. The distal end of the front cylinder block 1 and the distal end of the rear cylinder block 2 are covered by a front and rear housing sections 7 and 8. A front valve plate 5 and a rear valve plate 6 are disposed intermediate their respective cylinder blocks and housing sections.

Figure 2:
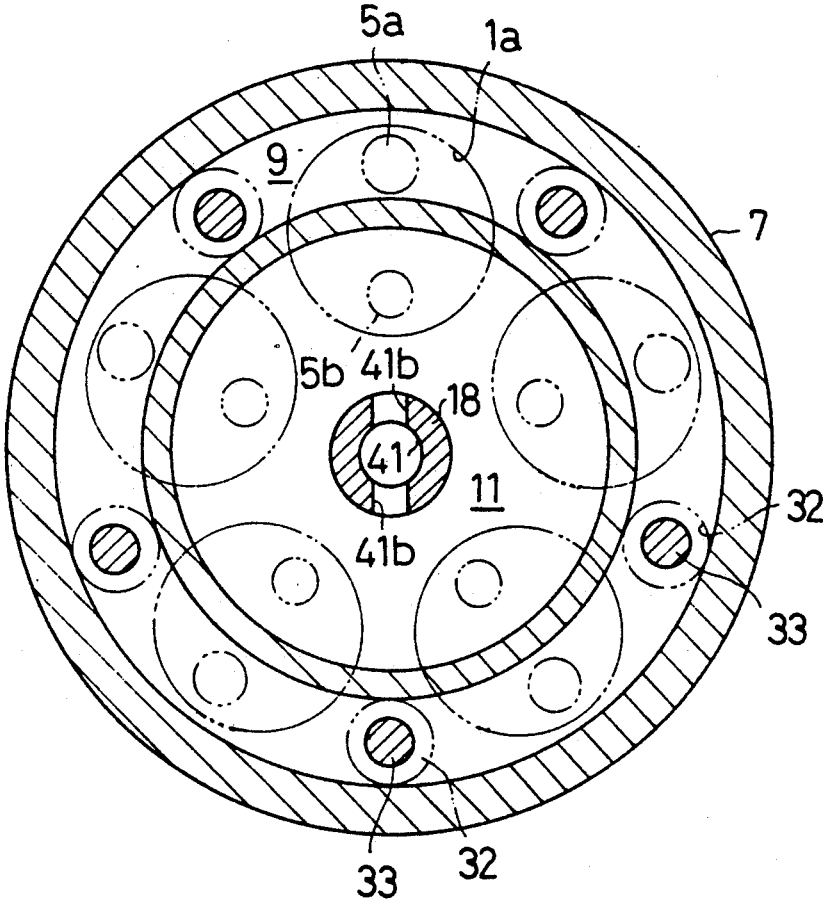
FIG. 2 is a cross sectional view of the compressor of FIG. 1, taken along line 2—2.

While FIG. 2 illustrates a cross sectional view of the front housing section 7, it should be understood that the rear housing section 8 is substantially similarly designed to the front housing section 7. The front housing section 7 includes an outer ring shaped front suction chamber 9, which is generally concentrically located around an inner ring shaped front discharge chamber 11. The front discharge chamber 11 is in turn concentrically located around a portion of a drive shaft 18.

The drive shaft 18 rotatably engages an axial opening 1*f* which extends through the front and rear cylinder blocks 1 and 2, and which is supported by radial bearings 14 and 15 and sealing devices 16 and 17. The drive shaft 18 further penetrates through an opening 5*c* provided in the front valve plate 5, and extends outwardly through the front housing section 7 via a sealing device 19 accommodated in a sealing space 13.

A swash plate 23 is mounted on the drive shaft 18, and rotates within the crank case 4. The swash plate 23 is supported by the front and rear cylinder blocks 1 and 2 via thrust bearings 21 and 22 respectively.

The front and rear cylinder blocks 1 and 2 include a plurality of cylinders, such as the cylinders 1*a* and 2*a*, which are arranged in parallel with the drive shaft 18, at specified intervals therearound. Each cylinder 1*a* and 2*a* houses a two-head type piston 25. Each piston 25 engages the swash plate 23 via a pair of shoes 24.

The front and rear valve plates 5 and 6 contain suction ports 5*a* and 6*a* respectively. These suction ports 5*a* and 6*a* connect the front and rear suction chambers 9 and 10 with the cylinders 1*a* and 2*a*, via suction valves 30 and 31. The front and rear valve plates 5 and 6 also contain discharge ports 5*b* and 6*b* respectively. These discharge ports 5*b* and 6*b* connect the front and rear discharge chambers 11 and 12 with the cylinders 1*a* and 2*a* via discharge valves 30 and 31.

A plurality of suction passages 32 are provided along the outside circumference of the front and rear cylinder blocks 1 and 2, and connect the crank case 4 with the front and rear suction chambers 9 and 10. A bolt 33 penetrates through the suction passage 32, and secures the front and rear housings 7 and 9 together. The rear discharge chamber 12 communicates with the axial opening 1*f* via a through hole 6*c* which penetrates the rear valve plate 6.

One important feature of the swash plate type compressor of the present invention relates to a discharge passage 40. The discharge passage 40 includes a hollow primary passage 41 which penetrates the drive shaft 18 along its axial length. An opening 41*a* of the primary passage 41 is positioned at the rear end of the drive shaft 18 in the axial opening 1*f*. A front end of the primary passage 41 communicates with the front discharge chamber 11, via through holes 41*b* which are radially provided in the front part of the drive shaft 18. The discharge passage 40 also includes a secondary passage 42. The secondary passage 42 connects the front discharge chamber 11 with an external refrigerating circuit. A final discharge port 28 is provided at the end of the secondary passage 42.

A spiral groove 50 is formed on the inner wall of the primary passage 41 along the axis of the passage 41. The cross-section of the groove 50 is significantly smaller than that of the primary passage 41. When the shaft 18 rotates, the refrigerant and the oil mixed therein flow in the forward direction. The passage 41 constitutes a primary passage, while the groove 50 creates a secondary passage for the oil particles.

In other words, the spiral groove is formed so that, when the compressed refrigerant flows from the rear discharge chamber to the front discharge chamber, lubricating oil mixed with the refrigerant and flows in the same direction along the groove. Since the moleculer weights of the oil and refrigerant are different, the oil molecules tend to be centrifugally thrusted toward the inner wall. The viscous oil molecules are then drawn in the forward direction toward the groove 50. Once in the groove 50, the oil molecules are collected into droplets and thereafter flow toward the apertures 53, in the direction of the oil passage 52.

The terminal end of the spiral groove 50 is opened to the sealing space 13 via a through hole 51 provided in the drive shaft 18. The space 13 is formed in the discharge chamber 11. When the drive shaft 18 is rotated, the lubricating oil mixed with the refrigerant separates from the refrigerant along the groove 50, the separated oil is thereafter stored in the front discharge chamber 11.

An oil passage 52 interconnect the front discharge chamber 11 and the crank case 4. The oil passage 52 slants downwardly from the discharge chamber 11 toward the crank case 4. The diameter of the oil passage 52 is designed such that the passage 52 substantially prevents the refrigerant from flowing therethrough, and allows the oil to be recycled. That is, the oil flows into the crank case 4 from the front discharge chamber 11 and does not allow the refrigerant gas to pass through the oil passage 52.

A plurality of oil guide holes 53 are formed on the drive shaft 18. These holes 53 connect the radial bearings 14 and 15 to the primary passage 41. The lubricating oil is supplied to the bearings 14 and 15 via the holes 53.

In the above arrangement, the refrigerant in the external refrigerating circuit flows into the swash plate type compressor via the suction port 3. The refrigerant is guided into the crank case 4 and is further guided into the front and rear suction chambers 9 and 10, via their respective suction passages 32. The pistons 25 are driven by the swash plate 23 and the drive shaft 18, and move inside the cylinders 1*a* and 2*a*.

The pistons 25 draw the refrigerant into the cylinders 1*a* and 2*a* via the suction ports 5*a* and 6*a*. The refrigerant is then discharged from the cylinders 1*a* and 2*a* into the front and rear discharge chambers 11 and 12, via the discharge ports 5*b* and 6*b*.

The compressed refrigerant which was discharged into the rear discharge chamber 12 is guided into the primary passage 41 via the opening 41*a*. The refrigerant mixes with the refrigerant discharged from the front discharge chamber 11 via the through holes 41*b*. The refrigerant is then discharged into the external refrigerating circuit via the secondary passage 42 and the final discharge port 28.

As described above, the primary passage 41 of the discharge passage 40 is provided inside the drive shaft 18. Therefore, the refrigerant flowing through the crank case 4 and the suction passage 32 is insulated from the hot discharged refrigerant in the discharge passage 40.

In this arrangement, unnecessary heat transfer is avoided, and the compression deformation of the cylinders 1*a* and 2*a* is avoided as well. Furthermore, since a relative cool refrigerant is supplied to the external refrigerating circuit, the load to the external circuit is low, and the cooling ability of the compressor keeps high. The above arrangement also reduces the weight and the size of the compressor main body, and further improves the degree of freedom in designing the main components, including the front and rear cylinder blocks 1 and 2.

When the compressed refrigerant flows into the primary passage 41, a secondary flow is generated in the main flow of the refrigerant by the spiral groove 50. The direction of the secondary flow is generally perpendicular to the main flow of the refrigerant. The lubricating oil in the refrigerant is separated therefrom, and is guided by the spiral groove 50 downstream, due to the centrifugation force generated by the rotation of the drive shaft 18.

The oil is collected in the front discharge chamber 11 via the through hole 51 and the sealing space 13. The oil then returns to the crank case 4 via the oil passage 52. Subsequently, the oil is mixed with the refrigerant again, and is used to lubricate the swash plate 23, the shoes 24 and other components. Accordingly, the compressor is now properly lubricated, without an increasing in size.

In the above embodiment, the discharge passage 40 comprises the primary passage 41, and the secondary passage 42 between the front discharge chamber 11 and the final discharge port 28. The refrigerant in the primary passage 41 flows from the rear discharge chamber 12 to the front discharge chamber 11. However, it is possible to adapt a reversed design with respect to the direction of the refrigerant flow as follows:

1) A final discharge port is provided at a position that is shifted outwardly from the center of the rear discharge chamber 12, and 2) A passage corresponding to the secondary passage 42 is formed at the rear housing 8, between the discharge port and the rear discharge chamber 12.

In this arrangement, the compressed refrigerant flows through the primary passage 41 from the front discharge chamber 11 into the rear discharge chamber 12. The separated oil by the groove 50 comes in contact with the inner wall of the rear discharge chamber 12, and is collected in the bottom thereof under the force of gravity. The collected oil is returned to the crank case 4 via an oil passage, similar to the oil passage 52 in the above embodiment.

Furthermore, instead of using the spiral groove 50, it is possible to form a plurality of circular or spiral, grooves that are distally separated from each other along the length of the inner wall of the primary passage 41. The oil separated from the refrigerant by means of the circular grooves is supplied to the bearings through the oil leading holes 53.

The present examples and embodiments are to be considered as illustrative and not restrictive, and the invention is not to be limited to the details given herein.

What is claimed is:

1. A compressor including a pair of cylinder blocks having a plurality of cylinders and a crank case leading to a suction port, a pair of housing sections having at least two discharge chambers, and covering both ends of the pair of cylinder blocks, a drive shaft being rotatably supported by the pair of cylinder blocks, a swash plate being mounted on the drive shaft and rotatably housed within the crank case, a plurality of pistons engaging the swash plate and moving within the cylinders in cooperation with the swash plate, wherein the refrigerant flows from the suction port into the cylinders via a suction passage, is compressed within each cylinder, is discharged into the discharge chambers via discharge ports, and is discharged out of the compressor via a final discharge port, the compressor comprising:

a discharge passage communicating with the discharge chambers, said discharge passage including a primary passage within the drive shaft; and a groove formed on an inner wall of the primary passage for causing oil contained in the refrigerant to be separated therefrom.

2. The compressor according to claim 1, wherein the compressor further includes an oil passage for connecting at least one of the discharge chambers to the crank case, and for returning the oil separated by said groove into the crank case from the discharge chamber.

3. The compressor according to claim 1, wherein the pair of housing sections includes a front and rear housing sections;

wherein the pair of cylinder blocks includes a front and rear cylinder blocks;

wherein the final discharge port is located within said front housing section; and wherein the discharge passage further includes a secondary passage for connecting the discharge port with at least one of the discharge chambers.

4. The compressor according to claim 1, wherein the groove is spirally shaped, the cross sectional area of said groove is smaller than that of the primary passage, and said groove causes the oil to flow in the same direction as that of the refrigerant when the drive shaft is rotated.

5. The compressor according to claim 2, wherein oil passage is slanted downwardly from at least one of the discharge chambers toward the crank case.

* * * * *